US008148912B2

(12) United States Patent
Kim

(10) Patent No.: US 8,148,912 B2
(45) Date of Patent: Apr. 3, 2012

(54) LIGHTING DEVICE WITH STAGGERED LIGHT SOURCES RESPONSIVE TO A SINGLE USER CONTROL

(75) Inventor: Paul Y. Kim, Santa Ana, CA (US)

(73) Assignee: SureFire, LLC, Fountain Valley, CA (US)

( * ) Notice: Subject to any disclaimer, the term of this patent is extended or adjusted under 35 U.S.C. 154(b) by 512 days.

(21) Appl. No.: 12/434,250

(22) Filed: May 1, 2009

(65) Prior Publication Data

US 2010/0277096 A1 Nov. 4, 2010

(51) Int. Cl.
*H05B 37/02* (2006.01)

(52) U.S. Cl. ..... 315/291; 315/307; 315/312

(58) Field of Classification Search ..... 315/291, 315/294, 297, 307, 312
See application file for complete search history.

(56) References Cited

U.S. PATENT DOCUMENTS

| | | | | |
|---|---|---|---|---|
| 5,255,168 | A | 10/1993 | Stevens | |
| 5,359,501 | A | 10/1994 | Stevens | |
| D482,471 | S | 11/2003 | Shiu | |
| D482,472 | S | 11/2003 | Shiu | |
| D482,473 | S | 11/2003 | Shiu | |
| 6,736,529 | B1 | 5/2004 | Lee | |
| 6,841,941 | B2 | 1/2005 | Kim et al. | |
| D508,140 | S | 8/2005 | Sharrah | |
| 7,186,002 | B2 | 3/2007 | Matthews et al. | |
| 7,220,016 | B2 | 5/2007 | Matthews et al. | |
| 7,293,893 | B2 | 11/2007 | Kim | |
| RE40,027 | E | 1/2008 | Matthews | |
| 7,344,270 | B2 | 3/2008 | Kim | |
| 7,513,660 | B2 | 4/2009 | Spartano et al. | |
| 2003/0057884 | A1 * | 3/2003 | Dowling et al. | 315/291 |
| 2005/0116665 | A1 * | 6/2005 | Colby et al. | 315/291 |
| 2005/0237737 | A1 | 10/2005 | Kim | |
| 2007/0171629 | A1 | 7/2007 | Langenwalter | |
| 2007/0195522 | A1 | 8/2007 | Matthews | |
| 2007/0247839 | A1 | 10/2007 | Matthews | |
| 2009/0273300 | A1 * | 11/2009 | Kayser | 315/291 |
| 2010/0045190 | A1 * | 2/2010 | Cramer | 315/151 |

OTHER PUBLICATIONS

U.S. Appl. No. 12/391,491, Hunt, William A.
U.S. Appl. No. 12/434,235, Kim, Paul Y.
U.S. Appl. No. 29/336,367, filed May 1, 2009, Kim, Paul Y.
KROMA—Flexible LED Flashlight with White, Blue, & Red Beams from SureFire, http://www.surefire.com/maxexp/main.pl?pgm=co_disp&func=displ&strfnbr=6&prrfnbr=24412&sesent=0,0&search_id=1344499, pp. 1 and 2.
A2 Aviator LED Flashlight, http://www.surefire.com/maxexp/main.pl?pgm=co_disp&func=displ&strfnbr=6&prrfnbr=900&sesent=0,0&search_id=1344500, pp. 1 and 2.

(Continued)

*Primary Examiner* — Don Le
(74) *Attorney, Agent, or Firm* — Haynes and Boone, LLP

(57) ABSTRACT

Various lighting devices and related methods of operation are provided which may be used to adjust brightness levels of a plurality of light sources in a staggered fashion in response to a single user control. In one example, a lighting device includes a plurality of light sources. Each light source is adapted to exhibit an associated current brightness level within a range of brightness levels associated with each light source extending from an associated minimum brightness level to an associated maximum brightness level. The lighting device also includes a user control adapted to selectively adjust the current brightness levels exhibited by the light sources in a staggered fashion such that the light sources exhibit different current brightness levels from each other over at least a range of positions of the user control.

22 Claims, 8 Drawing Sheets

OTHER PUBLICATIONS

Surefire 9AN Commander—9AN000 Rechargeable Flashlight, http://www.surefire.com/maxexp/main.pl?pgm=co__disp&func=displ&strfnbr=6&prrfnbr=949&sesent=0,0&search__id=1344503, pp. 1 and 2.
Norman, LH500 Lamphead, 810788, B&H Photo Video, http://www.bhphotovideo.com/c/product/38326-REG/Norman__810788__LH500__Lamphead.html, pp. 1 and 2.
X-Zoom—Headlamps—Mammut, http://www.mammut.ch/en/productDetail/232000120__v__0001X-Zoom.html, pp. 1 and 2.
Headlamps & Lights: Headlamps Rescue & Outdoor Sporting, http://www.urbanhart.com/shopsite/headlampslights__headlamps.html, pp. 1-15.
First Light USA, http://www.first-light-usa.com/tomahawkmain.php, pp. 1-9.
Streamlight Sidewinder Tactical LED Flashlight, http://www.streamlight-flashlights.com/sidewinder.html, pp. 1 and 2.
Buickmasters Camo Twin-Task 2L Hunting Flashlight—51025, http://www.streamlight-flashlights.com/51025.html, p. 1.
Amazon.com: Underwater Kinetics 3AAA Vizion eLED Headlamp: Sports & Outdoors, http://www.amazon.com/Underwater-Kinetics-3AAA-Vizion-Headlamp/dp/B001G5ZG2K, pp. 1-6.
Backpacker Magazine, Mammut X-Zoom, Apr. 2009, pp. 1 and 2.
SureFire catalog, Saint ultra high output LED headlamp and Minimus compact ultra high output LED headlamp, Jan. 15, 2009, 1 page.

* cited by examiner

LIGHTING DEVICE WITH STAGGERED LIGHT SOURCES RESPONSIVE TO A SINGLE USER CONTROL

BACKGROUND

1. Field of the Invention

The present invention generally relates to lighting devices and more particularly to lighting devices having a plurality of light sources.

2. Related Art

Portable lighting devices such as flashlights, headlamps, and other types of lighting devices may be implemented with one or more light sources which may be used to illuminate areas of interest. In particular, lighting devices having a plurality of light sources can be useful in that different types of light sources, such as light sources providing different beam patterns or different wavelengths, may be provided in a single device. Unfortunately, many existing lighting devices that include multiple light sources are often difficult and cumbersome to control.

For example, certain lighting devices may include separate controls for different light sources. In this regard, a user may be forced to select from among a variety of different controls when operating the lighting device. Unfortunately, such implementations can require the user to remember and differentiate between the different controls. This can this can complicate the operation of the lighting device for the user, especially if adjustments to multiple light sources are desired. As an example, in dark environments, there may be insufficient light for the user to reliably distinguish between multiple controls. As another example, in stressful environments, there may be insufficient time for the user to distinguish between multiple controls. Accordingly, there is a need for an improved lighting device that overcomes one or more of the deficiencies discussed above.

SUMMARY

Various lighting devices and methods of operation are provided which may be used to adjust brightness levels of a plurality of light sources in a staggered fashion in response to a single user control. In one embodiment, a lighting device includes a plurality of light sources. Each light source is adapted to exhibit an associated current brightness level within a range of brightness levels associated with each light source extending from an associated minimum brightness level to an associated maximum brightness level. The lighting device also includes a user control adapted to selectively adjust the current brightness levels exhibited by the light sources in a staggered fashion such that the light sources exhibit different current brightness levels from each other over at least a range of positions of the user control.

In another embodiment, a method of operating a lighting device is provided. The lighting device includes a user control and a plurality of light sources. Each light source is adapted to exhibit an associated current brightness level within a range of brightness levels associated with each light source extending from an associated minimum brightness level to an associated maximum brightness level. The method includes detecting an adjustment of the user control. The method also includes selectively adjusting the current brightness levels exhibited by the light sources in a staggered fashion in response to the detecting such that the light sources exhibit different current brightness levels from each other over at least a range of positions of the user control.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
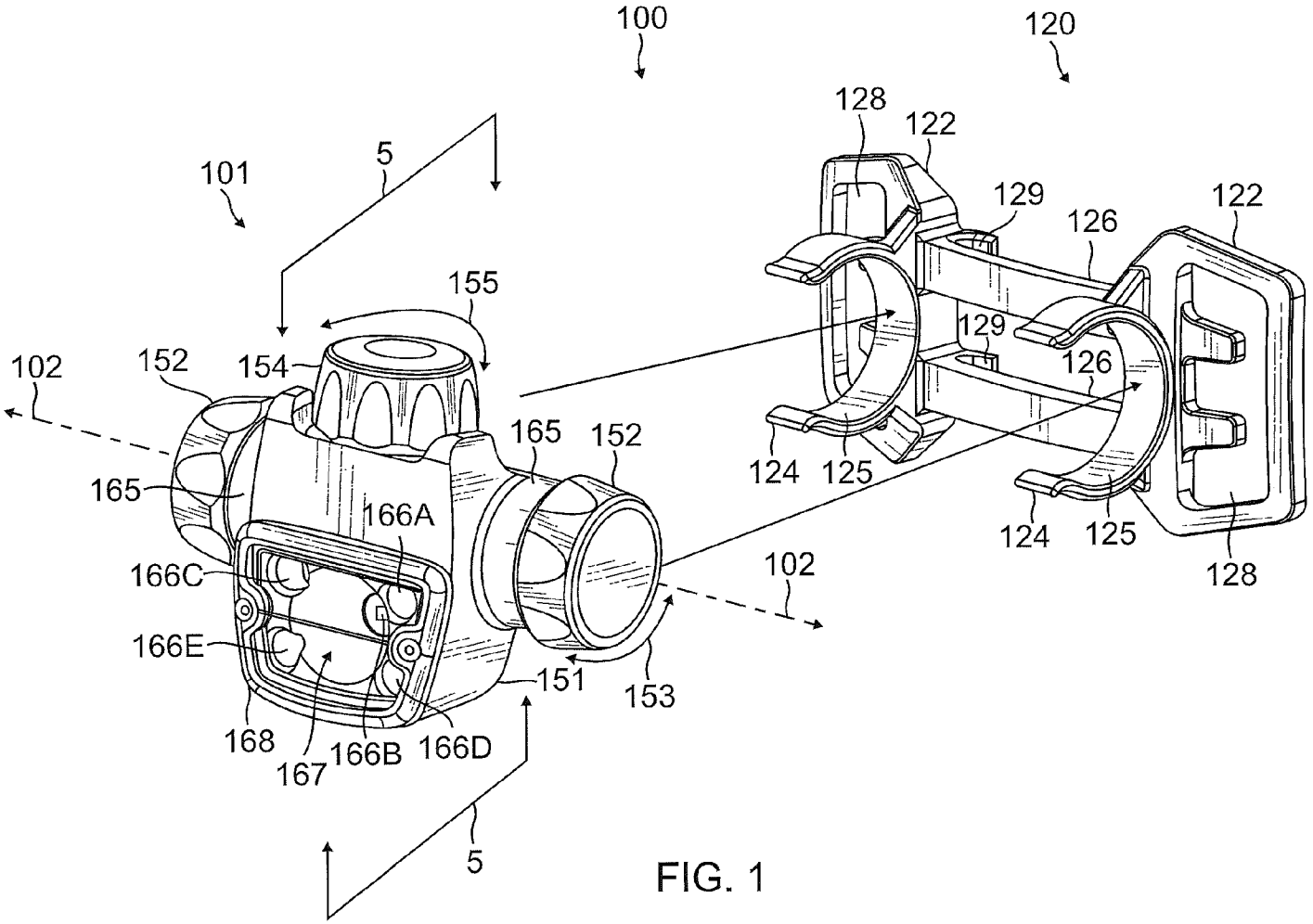
FIG. 1 illustrates a lighting device including a main body and a removable cradle in accordance with an embodiment of the invention.
Figure 2:
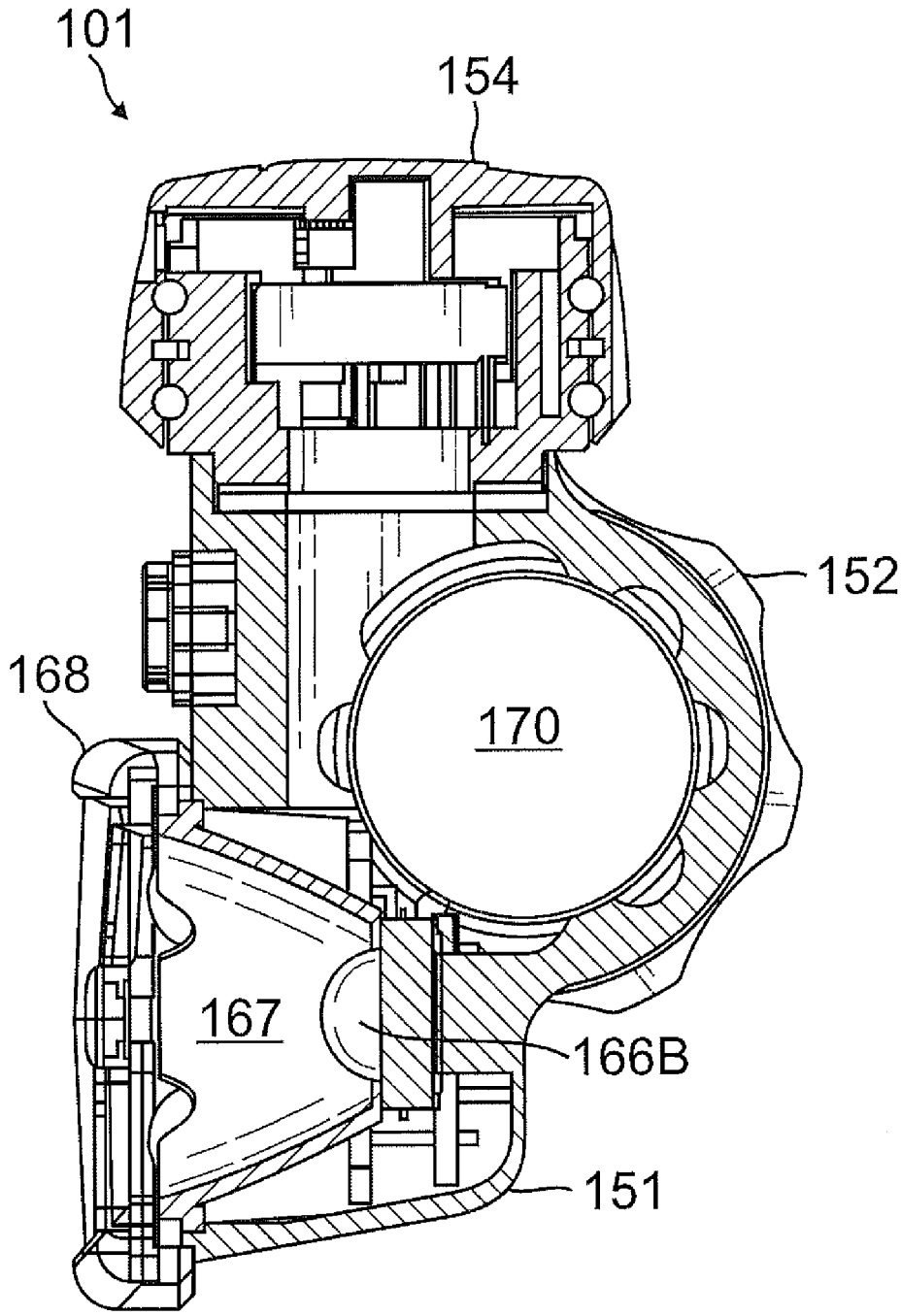
FIG. 2 illustrates a cross-section view taken at line 5-5 of the main body of the lighting device of FIG. 1 in accordance with an embodiment of the invention.

FIG. 1 illustrates a lighting device 100 including a main body 101 and a cradle 120 configured to receive lighting device 100 in accordance with an embodiment of the invention, and FIG. 2 illustrates a cross-section view taken at line 5-5 of main body 101 in accordance with an embodiment of the invention.

Main body 101 of lighting device 100 is configured to be inserted into cradle 120 and also may be selectively removed from cradle 120. In this regard, main body 101 may be advantageously attached to cradle 120 and positioned in any convenient location where cradle 120 is positioned. For example, in one embodiment, cradle 120 may be positioned on a user's head to facilitate using lighting device 100 as a headlamp. However, lighting device 100 need not be limited to headlamp applications. For example, in other embodiments, cradle 120 may be positioned in other locations, such as on a belt, clothing, wrist strap, or other locations which may be convenient to a user. In other embodiments, main body 101 may be removed from cradle 120 to facilitate handheld use of main body 101 (e.g., as a flashlight) by a user or placement of main body 101 in other locations.

Main body 101 includes a housing 151 having a substantially elongate shape extending in a substantially vertical direction. Main body 101 includes mounting members 165 exhibiting substantially cylindrical exterior surfaces on either side of housing 151. Main body 101 may be selectively connected to cradle 120 through engagement of mounting members 165 with cradle 120. In this regard, cradle 120 includes two support members 124 which have substantially arcuate interior surfaces 125 that may be engaged with the substantially cylindrical exterior surfaces of mounting members 165 when mounting members 165 are inserted into support members 124.

While main body 101 is engaged with cradle 120 (e.g., through engagement of mounting members 165 and support members 124), housing 151 may be rotated relative to cradle 120 along an axis 102 in the directions denoted by arrows 153 to adjust the angle of light emitted by one or more light sources 166A-E further described herein.

Advantageously, the weight of housing 151 is supported by both of support members 124. Because housing 151 is engaged with cradle 120 through support members 124 and mounting members 165, the center of gravity of main body 101 is situated in close proximity to support members 124 and the remaining portions of cradle 120.

Main body 101 includes end caps 152 connected to mounting members 165 on either side of housing 151. A user may grasp housing 151 or end caps 152 to rotate main body 101 relative to cradle 120. Advantageously, the shape of housing 151 permits the center of gravity of main body 101 to be horizontally positioned between support members 124 and vertically positioned substantially level with or lower than (e.g., below) axis 102, support members 124, and/or mounting members 165. Such positioning of the center of gravity allows gravitational forces to substantially pull housing 151 into a stable position (e.g., without causing main body 101 to be top heavy or cantilevered which could result in unintentional rotation of main body 101). As a result, cradle 120 is configured to hold housing 151 in a stable, reliable manner while still permitting housing 151 to rotate.

Figure 3:
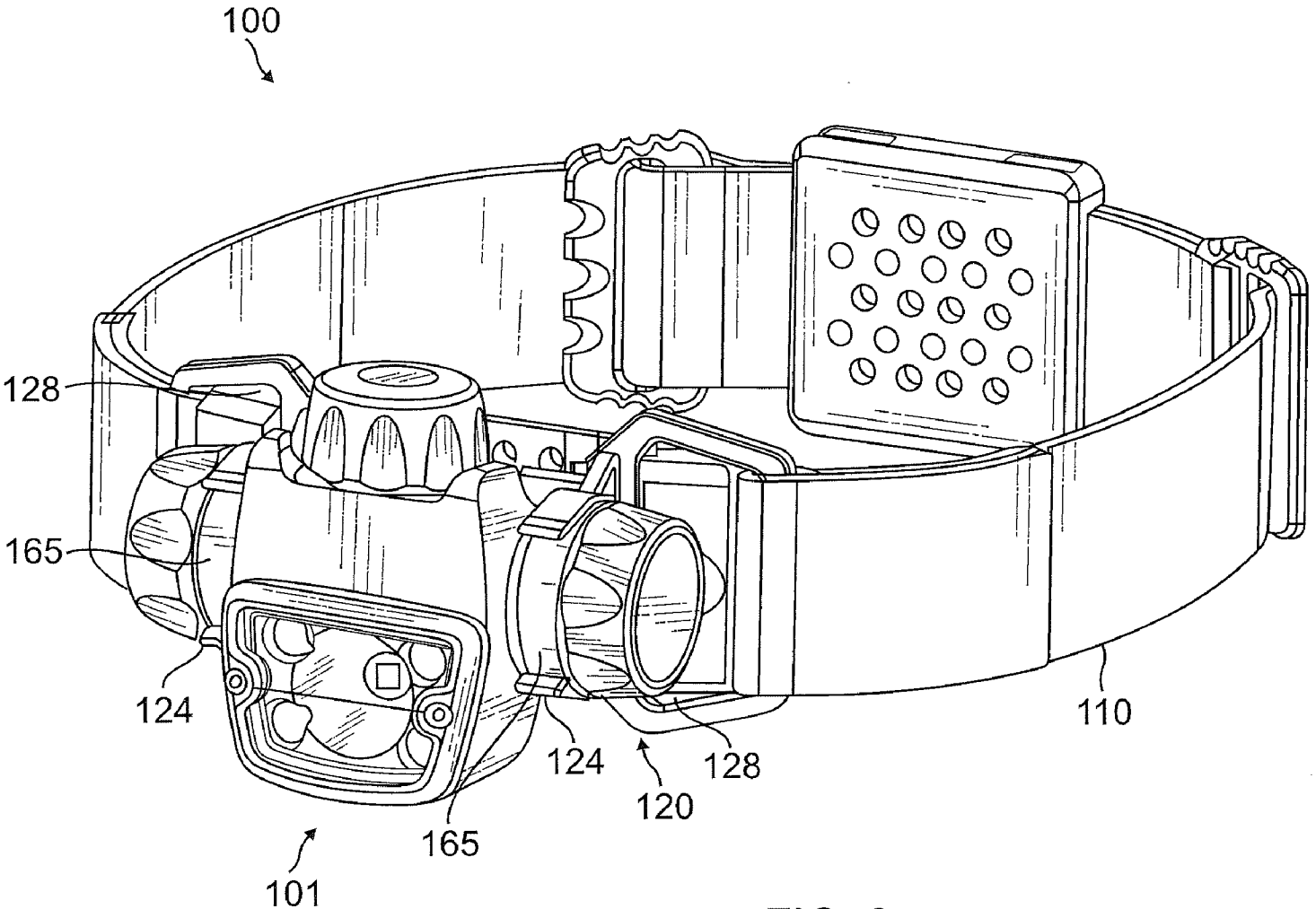
FIG. 3 illustrates the lighting device of FIG. 1 including a strap in accordance with an embodiment of the invention.

Cradle 120 includes connecting members 122 and 126 that include apertures 128 and 129 which may receive various straps or other mounting devices for positioning cradle 120 in desired locations. For example, FIG. 3 illustrates main body 101 and cradle 120 connected to a strap 110 in a headlamp configuration in accordance with an embodiment of the invention. In this regard, strap 110 passes through apertures 128 of connecting members 122 to secure cradle 120 to strap 110. In this configuration, cradle 120 may be positioned in front of a user's forehead and strap 110 may be configured to wrap around the user's head to secure lighting device 100 to the user.

Figure 4:
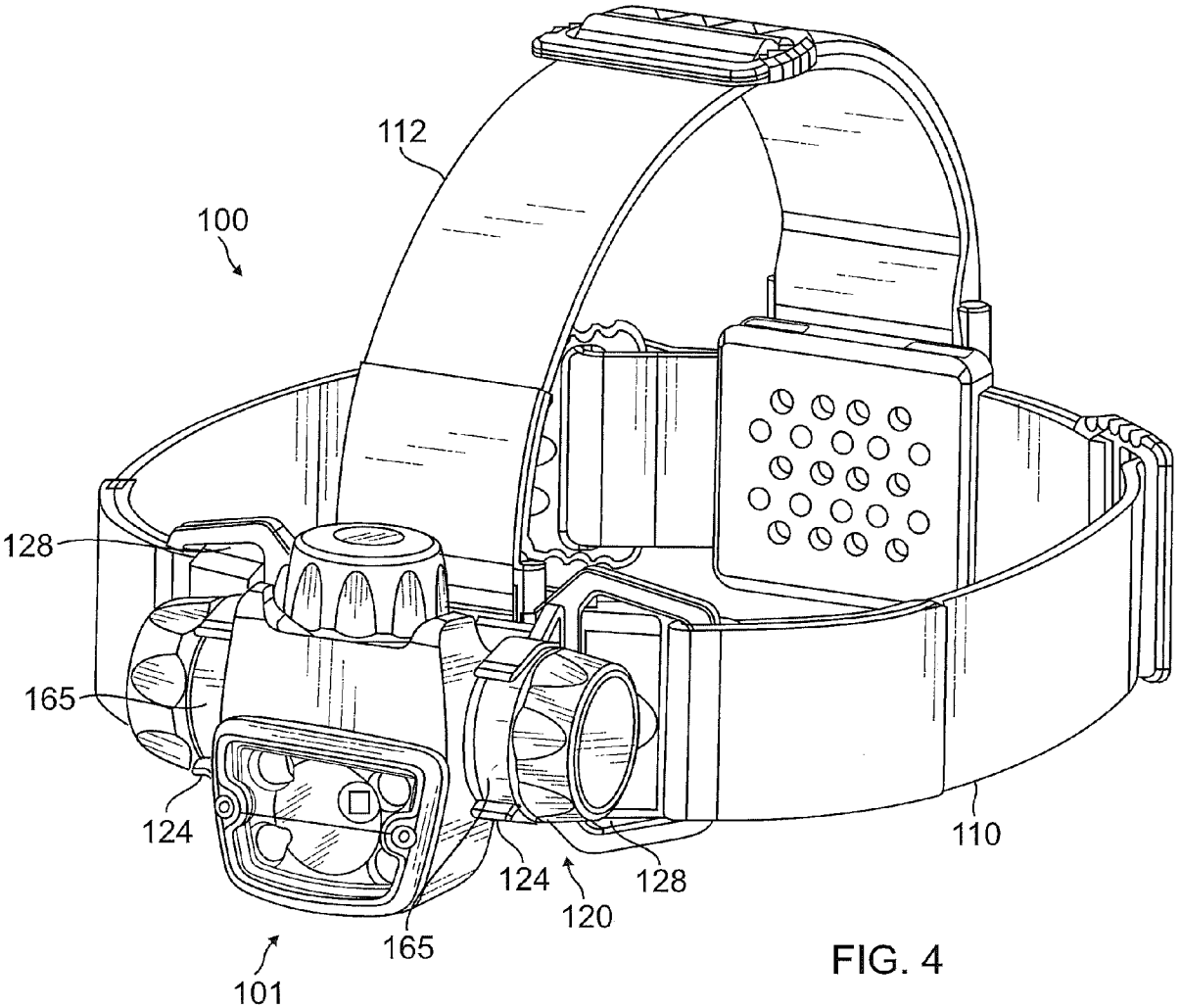
FIG. 4 illustrates the lighting device of FIG. 1 including another strap in accordance with an embodiment of the invention.

As another example, FIG. 4 illustrates main body 101 and cradle 120 connected to strap 110 and also connected to a strap 112 in another headlamp configuration in accordance with an embodiment of the invention. In this regard, strap 112 passes through apertures 129 of connecting members 126 to secure cradle 120 to strap 112. In this configuration, strap 112 may be configured to wrap over a top of the user's head to further secure lighting device 100 to the user.

Main body 101 also includes a user control 154 mounted substantially on a top side of housing 151. User control 154 may be rotated relative to housing 151 to adjust a potentiometer or other appropriate control of lighting device 100 to adjust, for example, the intensity of light emitted by one or more of light sources 166A-E. For example, the user may grasp user control 154 to rotate user control 154 in the directions denoted by arrows 155 relative to body 150. Advantageously, the location of user control 154 on the top side of housing 151 permits a user to adjust user control 154 without causing housing 151 to rotate along axis 102. As a result, main body 101 can remain in a desired position (e.g., rotated to a desired angle relative to cradle 120) while the user operates user control 154.

In addition, the position of user control 154 on the top side of housing 151 permits the user to adjust user control 154 without unintentionally interfering with the light provided by light sources 166A-E. In this regard, the user's hand may be placed on the top side of housing 151 rather than in front of light sources 166A-E (e.g., within beam patterns emitted by light sources 166A-E) which could otherwise interrupt beam patterns emitted by light sources 166A-E. As a result, the user can avoid inadvertently interrupting beam patterns emitted by light sources 166A-E (e.g., avoid casting a shadow) over an illuminated area of interest while adjusting user control 154.

Although user control 154 is illustrated as a user-rotatable dial (e.g., a knob), other embodiments are also contemplated. For example, in other embodiments, user control 154 may be implemented as a slider (e.g., connected to a potentiometer that slides along an axis), a spring loaded lever, a toggle switch, a switch having separate increment and decrement positions, two or more switches (e.g., an increment switch and a decrement switch), or other appropriate controls.

Lighting device 100 includes five light sources labeled 166A-E. Although five light sources are shown, any desired number of light sources, and any desired types of light sources may be used. For example, in various embodiments, light sources 166A-E may be implemented as light emitting diodes (LEDs), incandescent light sources, visible light sources, non-visible light sources (e.g., emitting infrared, ultraviolet, and/or other light wavelengths), spotlights, floodlights, and/or other appropriate types of light sources as may be desired in particular implementations.

Light sources 166A-E are mounted within a lens assembly 167 (e.g., which may be implemented to include a plurality of lenses, each of which may provide total internal reflection of light from a corresponding one or more of light sources 166A-E) in housing 151. Light sources 166A-E and lens assembly 167 are mounted within housing 151 behind a window assembly 168.

As shown in FIG. 4, housing 151 includes a substantially cylindrical chamber 170. Chamber 170 may receive a battery (e.g., a conventional AA or AAA battery) for powering lighting device 100.

Figure 5:
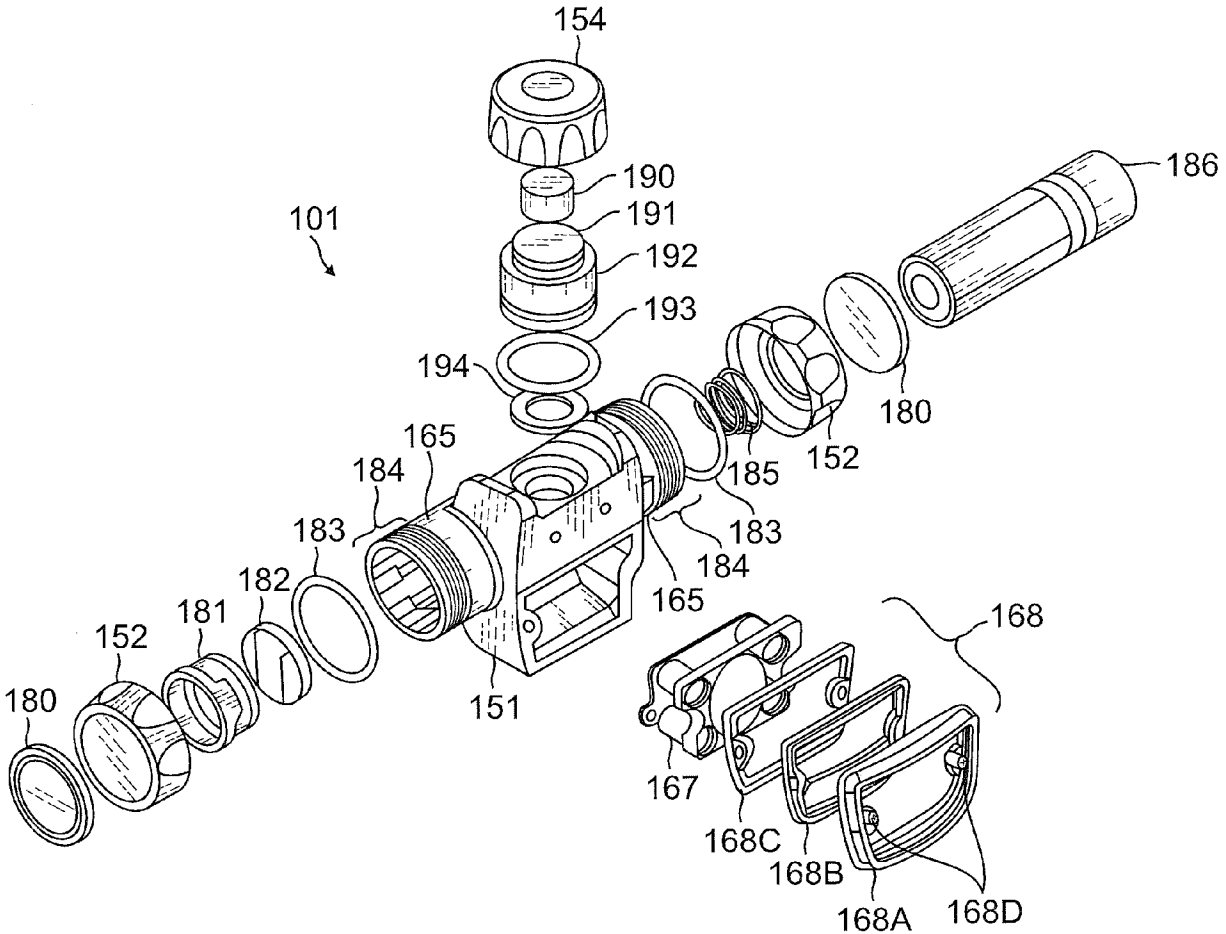
FIG. 5 illustrates an exploded view of the main body of the lighting device of FIG. 1 in accordance with an embodiment of the invention.

FIG. 5 illustrates an exploded view of main body 101 in accordance with an embodiment of the invention. In addition to various components of main body 101 previously described herein, FIG. 5 also shows several additional components.

For example, FIG. 5 further illustrates plates 180, a printed circuit board (PCB) 181, a contact plate 182, o-rings 183, threads 184, a spring 185, and a battery 186. Plates 180 may be inserted into end caps 152 and affixed or otherwise secured to end caps 152 using any appropriate product such as, for example, adhesive, glue, or other products. Plates 180 may include letters, symbols, and/or other appropriate insignia which remain visible when plates 180 are secured to end caps 152. Battery 186 may be inserted into chamber 170 (see FIG. 4) within housing 151 for powering light sources 166A-E, PCB 181, and a PCB 191. While inserted into chamber 170, battery 186 engages with contact plate 182 and spring 185. PCB 181 and/or PCB 191 may be used to provide appropriate circuitry for operating light sources 166A-E in response to control signals generated in response to operation of user control 154. End caps 152 may be engaged with threads 184 to secure end caps 152 to mounting members 165. In this regard, o-rings 183 may be used to seal end caps 152 against housing 151.

FIG. 5 also illustrates various components of window assembly 168. In this regard, window assembly 168 includes a reflector cap 168A, a reflector mirror 168B, and a reflector ring 168C, all of which may be secured to lens assembly 167 by screws 168D.

In addition, FIG. 5 illustrates a switch 190, PCB 191, a switch cap 192, an o-ring 193, and a switch ring 194. Switch 190 engages with user control 154 and PCB 191. In this regard, switch 190 may rotate with user control 154. PCB 181 and/or PCB 191 may detect the position of user control 154, and adjustments thereof, using switch 190 and generate one or more control signals for operating light sources 166A-E in various ways further described herein. User control 154, switch 190, and PCB 191 may be received by switch cap 192 which is inserted into body with switch ring 194 and sealed against housing 151 by o-ring 193.

The implementation of switch 190 and other relevant components of lighting device 100 may be changed in embodiments having different implementations of user control 154. For example, switch 190 may be implemented in an appropriate manner (e.g., as a potentiometer that slides along an axis, a switch responsive to a spring loaded lever, a switch responsive to a toggle switch, a switch having separate increment and decrement positions, two or more switches, or other appropriate switch implementations) to engage with user control 154 in such embodiments.

Figure 6:
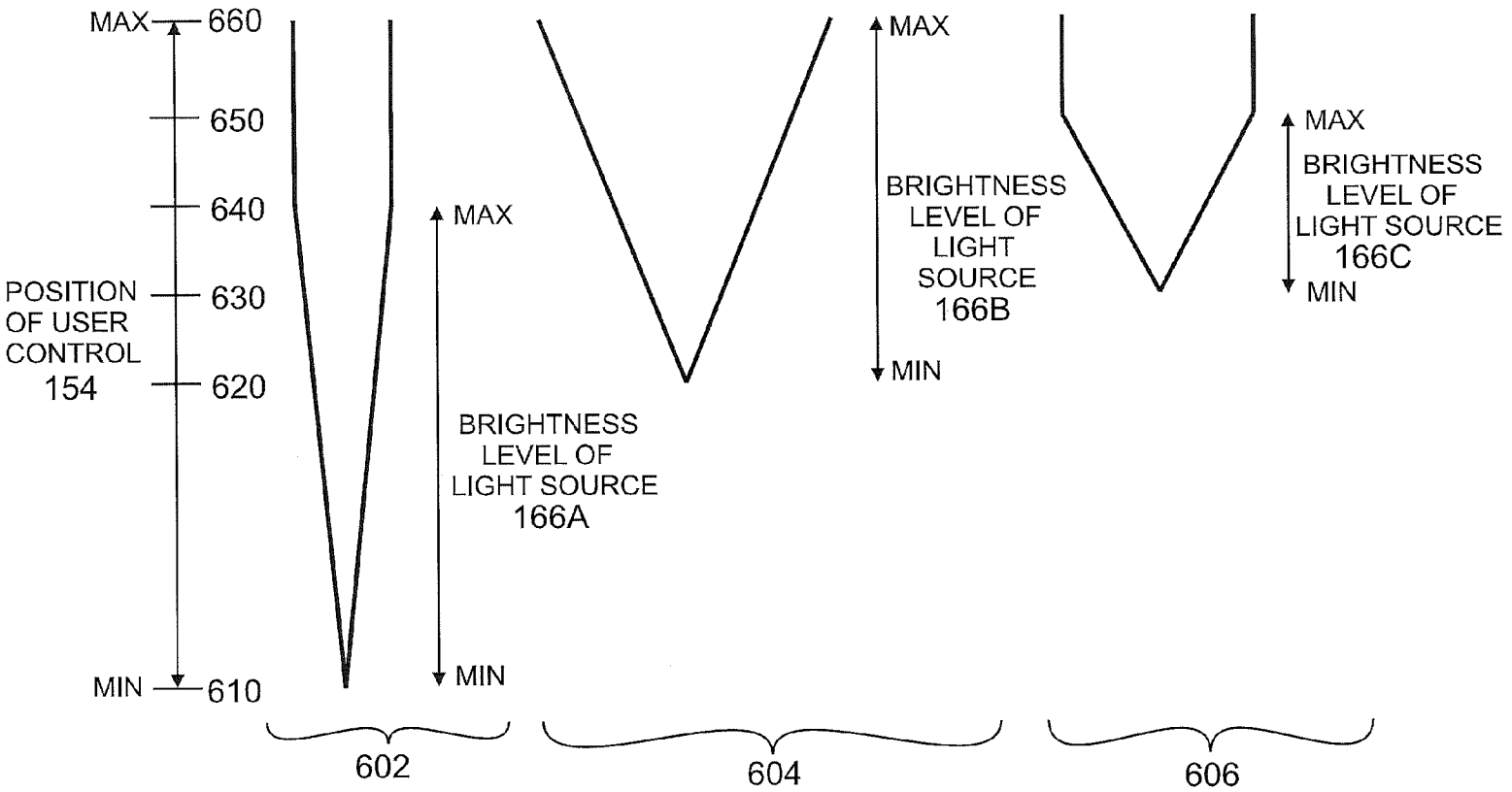
FIG. 6 illustrates changes in the relative brightness of a plurality of different light sources of the lighting device of FIG. 1 in response to a single user control in accordance with an embodiment of the invention.
Figure 7:
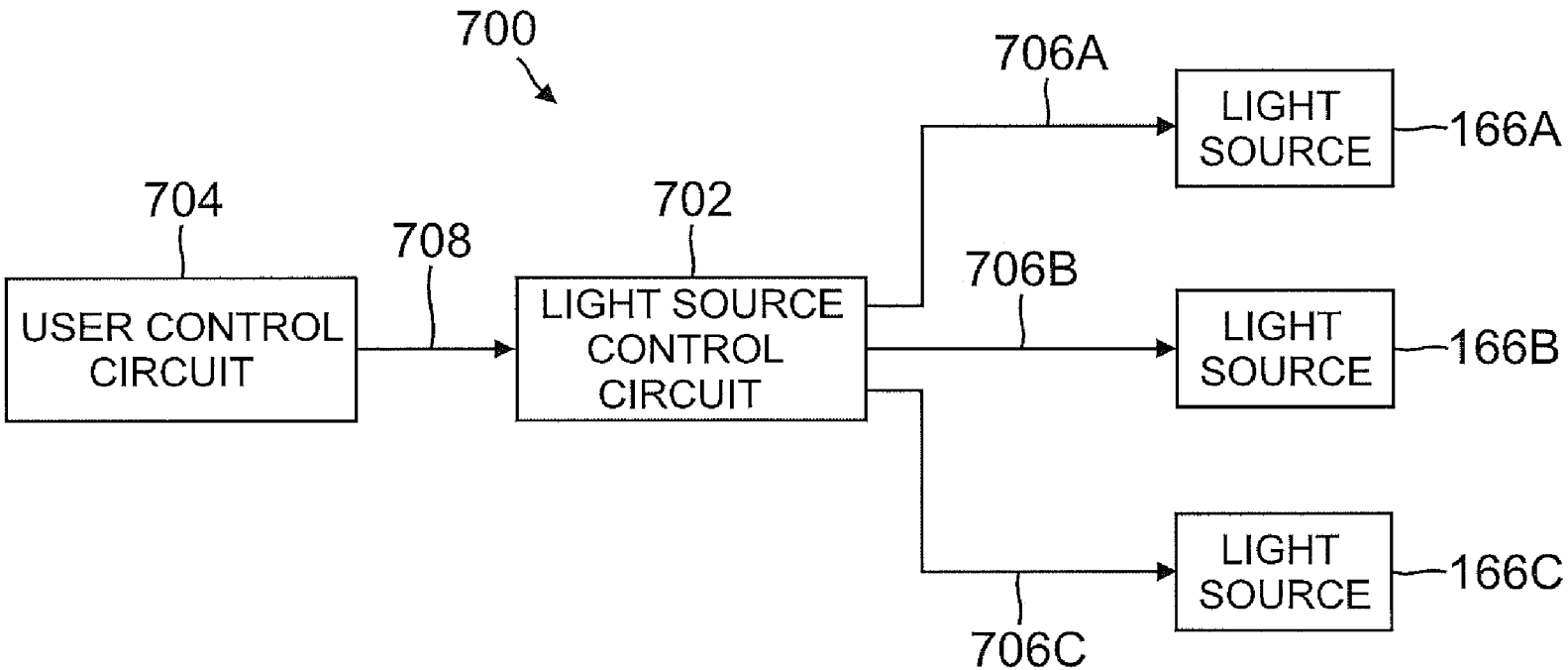
FIG. 7 illustrates a block diagram of control circuitry of the lighting device of FIG. 1 in accordance with an embodiment of the invention.

FIG. 6 illustrates changes in the relative brightness (e.g., intensity) of light sources 166A-C of lighting device 100 in response to operation of user control 154 in accordance with an embodiment of the invention, and FIG. 7 illustrates a block diagram 700 of control circuitry of lighting device 100 in accordance with an embodiment of the invention. For example, in one embodiment, various components of block diagram 700 may be used to control light sources 166A-C to operate in the manner identified in FIG. 6.

Although the following descriptions of FIGS. 6-7 refer to light sources 166A-C, the features described with regard to one or more of light sources 166A-C may be similarly applied to light sources 166D-E and/or other light sources of lighting device 100. Moreover, although the various features of FIG. 6-7 are described with regard to lighting device 100 implemented as a headlamp, such features may be used in any type of lighting device 100 where desired (e.g., a flashlight or other appropriate type of lighting device).

FIG. 6 show beam patterns 602, 604, and 606 which correspond to the relative brightness of light sources 166A, 166B, and 166C, respectively, in response to adjustment of user control 154 from a minimum position to a maximum position. As shown in FIG. 6, light sources 166A-C may transition from a minimum brightness level to a maximum brightness level in a staggered fashion such that light sources 166A-C may exhibit minimum, intermediate, and maximum brightness levels corresponding to different positions of user control 154.

As previously described, light sources 166A-C may be implemented as different types of light sources. As such, light sources 166A-C may exhibit different beam patterns (e.g., different dispersion patterns) as denoted by the different widths of beam patterns 602, 604, and 606. For example, in one embodiment, light source 166A may be implemented as a spotlight having a relatively narrow beam pattern as indicated by the narrow width of beam pattern 602. In another embodiment, light source 166B may be implemented as a floodlight having a relatively wide beam pattern as indicated by the wide width of beam pattern 604 in comparison to beam pattern 602. In another embodiment, light source 166C may be implemented as a light source having an intermediate beam pattern as indicated by the intermediate width of beam pattern 606 in comparison to beam patterns 602 and 604.

For purposes of illustration, beam patterns 602, 604, and 606 are shown separately from each other. However, in various embodiments, beam patterns 602, 604, and 606 may overlap with some or all of each other.

In various embodiments, light sources 166A-C may be implemented with similar or different minimum and maximum brightness levels. For example, in one embodiment, the minimum and maximum brightness levels of light sources 166A-C may be substantially similar to each other. In another embodiment, the maximum brightness levels of light sources 166A-C may differ from each other such that, for example, when light sources 166A and 166B are both set to their maximum brightness levels, light source 166B may still be brighter than light source 166A. In another embodiment, the minimum brightness levels of light sources 166A-C may differ from each other such that, for example, when light sources 166A and 166B are both set to their minimum brightness levels, light source 166B may still be brighter than light source 166A.

The operation of user control 154 will now be further described with regard to beam patterns 602, 604, and 606. When user control 154 is at a minimum position 610 (e.g., an off position), all of light sources 166A-C remain turned off (e.g., exhibiting minimum brightness).

As user control 154 is adjusted from position 610 to position 620, light source 166A turns on and gradually increases in brightness until reaching approximately 50 percent brightness when user control 154 reaches position 620. Light sources 166B-C remain turned off as user control 154 transitions from position 610 to position 620.

As user control 154 is adjusted from position 620 to position 630, light source 166A further increases in brightness until reaching approximately 80 percent brightness when user control 154 reaches position 630. Light source 166B turns on as user control passes position 620 and further increases in brightness until reaching approximately 30 percent brightness when user control 154 reaches position 630. Light source 166C remains turned off as user control 154 transitions from position 620 to position 630.

As user control 154 is adjusted from position 630 to position 640, light source 166A further increases in brightness until reaching its maximum brightness when user control 154 reaches position 640. Light source 166B further increases in brightness until reaching approximately 50 percent brightness when user control 154 reaches position 640. Light source 166C turns on as user control passes position 630 and further increases in brightness until reaching approximately 50 percent brightness when user control 154 reaches position 640.

As user control 154 is adjusted from position 640 to position 650, light source 166A remains at its maximum brightness level. Light source 166B further increases in brightness until reaching approximately 80 percent brightness when user control 154 reaches position 650. Light source 166C further increases in brightness until reaching its maximum brightness when user control 154 reaches position 650.

As user control 154 is adjusted from position 650 to position 660, light source 166A remains at its maximum brightness level. Light source 166B further increases in brightness until reaching its maximum brightness level when user control 154 reaches position 660. Light source 166C remains at its maximum brightness level as user control is adjusted from position 650 to position 660.

As user control 154 is adjusted in the reverse direction from position 660 through positions 650, 640, 630, and 620 to position 610, the brightness levels of light sources 166A-C decrease in a similar staggered fashion. As a result, light sources 166A-C may turn on, turn off, and vary in brightness in a staggered fashion as user control 154 is adjusted.

The particular staggered implementation shown in FIG. 6 is provided for purposes of illustration and not limitation. Lighting device 100 may be implemented to control light sources 166A-C in accordance with any desired minimum and maximum brightness levels, staggered or not staggered, relative to user control 154. For example, although all of light sources 166A-C are illustrated as being turned on at the same time for at least a range of positions of user control 154 (e.g., all of light sources 166A-C remain turned on as user control 154 is adjusted from position 630 to position 660), light source 166A may alternatively turn off when user control 154 reaches position 640 and remain off as user control 154 is adjusted to position 660. Continuing this example, light source 166C may alternatively turn on when user control 154 reaches position 650 (e.g., light source 166C may turn on after light source 166A turns off) and remain on as user control 154 is adjusted from position 650 to position 660.

Advantageously, user control 154 permits a user to adjust the on/off states and brightness of all of light sources 166A-C using only a single control. This feature is desirable for users whose hands must remain free as much as possible to perform other tasks. In particular, such users may adjust a plurality of light sources 166A-C using only a single hand, without requiring manipulation of a plurality of different controls.

Referring now to FIG. 7, a light source control circuit 702 provides control signals 706A-C to light sources 166A-C in response to one or more control signals 708 received from a user control circuit 704. In one embodiment, light source control circuit 702 may be implemented by PCB 181 and/or PCB 191, and user control circuit 704 may be implemented by switch 190, PCB 181, and/or PCB 191. For example, as previously described, switch 190 may engage with user control 154 and may be adjusted as user control 154 is adjusted. This adjustment of switch 190 may cause PCB 181 and/or PCB 191 to generate one or more control signals (e.g., control signals 708) which may be provided to control circuit 702 (e.g., PCB 181 and/or PCB 191) for operating light sources 166A-E (e.g., including light sources 166A-C).

Thus, the adjustment of user control 154 can cause control signals 708 to be provided from user control circuit 704 to light source control circuit 702 to identify the position of user control 154 (e.g., positioned at any of the positions 610 to 660 identified in FIG. 6, or intermediate positions thereof).

In response to control signals 708, light source control circuit 702 may generate control signals 706A-C to adjust the brightness of light sources 166A-C in a staggered fashion, such as the implementation identified in FIG. 6, or other implementations. For example, in one embodiment, light source control circuit 702 may be implemented by a controller, microprocessor, or other appropriate device which may be programmed to provide any desired control signals 706A-C in response to control signals 708. As a result, light sources 166A-C may be controlled to achieve any desired staggered or non-staggered changes in brightness levels.

Figure 8:
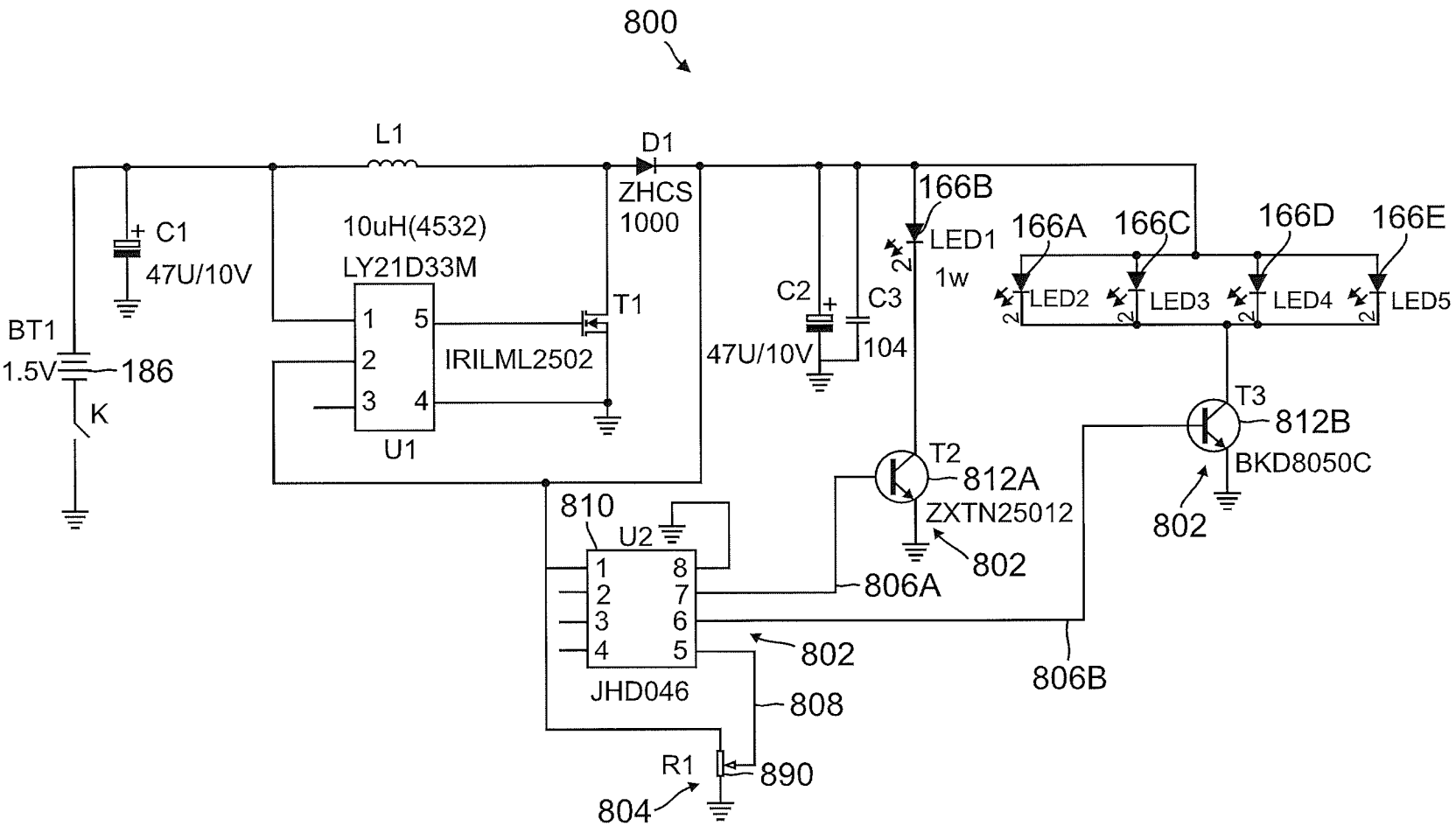
FIG. 8 illustrates a circuit diagram of the lighting device of FIG. 1 in accordance with an embodiment of the invention.

FIG. 8 illustrates a circuit diagram 800 of the lighting device of FIG. 1 in accordance with an embodiment of the invention. Circuit diagram 800 includes light sources 166A-E (shown implemented by LEDs in this embodiment), battery 186, a light source control circuit 802 (e.g., which may be used to implement light source control circuit 702 in one embodiment), a user control circuit 804 (e.g., which may be used to implement user control circuit 702 in one embodiment), and additional circuitry as shown. Light source control circuit 802 includes a programmable controller 810 and transistors 812A/812B, all of which may be implemented by PCB 181 and/or PCB 191. User control circuit 804 includes a potentiometer 890 which may be implemented by switch 190, PCB 181, and/or PCB 191.

User control circuit 804 provides a control signal 808 to programmable controller 810, for example, in response to adjustment of potentiometer 890 by a user operating user control 154. In response to control signal 808, programmable controller 810 of light source control circuit 802 may generate a control signal 806A to adjust the brightness of light source 166B, and may further generate a control signal 806B to adjust the brightness of light sources 166A and 166C-E. In this regard, control signals 806A-B control the operation of transistors 812A-B which cause changes in the brightness of light sources 166A-E. For example, in this embodiment, the brightness of light source 166B may be controlled independently from the brightness of light sources 166A and 166C-E to achieve any desired staggered or non-staggered changes in brightness levels.

Although two control signals 806A and 806B are shown in circuit diagram 800, any desired number of control signals may be generated and used in other embodiments to independently control any desired number of light sources in any desired staggered or non-staggered pattern, such as in accordance with the various patterns previously described herein.

Where applicable, the various components set forth herein can be combined into composite components and/or separated into sub-components without departing from the spirit of the present invention. Similarly, where applicable, the ordering of various steps described herein can be changed, combined into composite steps, and/or separated into sub-steps to provide features described herein.

The foregoing disclosure is not intended to limit the present invention to the precise forms or particular fields of use disclosed. It is contemplated that various alternate embodiments and/or modifications to the present invention, whether explicitly described or implied herein, are possible in light of the disclosure.

Embodiments described above illustrate but do not limit the invention. It should also be understood that numerous modifications and variations are possible in accordance with the principles of the present invention. Accordingly, the scope of the invention is defined only by the following claims.

What is claimed is:

1. A lighting device comprising:

a plurality of light sources, wherein each light source is adapted to exhibit an associated current brightness level within a range of brightness levels associated with each light source extending from an associated minimum brightness level to an associated maximum brightness level; and a user control adapted to selectively adjust the current brightness levels exhibited by the light sources in a staggered fashion such that the light sources exhibit different current brightness levels from each other over at least a range of positions of the user control.

2. The lighting device of claim 1, wherein the user control is adapted to adjust a current brightness level of a first one of the light sources from a first minimum brightness level to a first maximum brightness level as the user control is adjusted over a first range of positions extending from a first position to a second position; and wherein the user control is adapted to adjust a current brightness level of a second one of the light sources from a second minimum brightness level to a second maximum brightness level as the user control is adjusted over a second range of positions extending from a third position to a fourth position.

3. The lighting device of claim 2, wherein a portion of the first range overlaps with a portion of the second range.

4. The lighting device of claim 2, wherein the first and second ranges do not overlap with each other.

5. The lighting device of claim 1, further comprising a control circuit adapted to provide a plurality of light control signals to control the light sources in the staggered fashion in response to a user control signal received in response to an adjustment of the user control.

6. The lighting device of claim 1, wherein a first one of the light sources is adapted to emit a different beam pattern than a second one of the light sources.

7. The lighting device of claim 1, wherein a first one of the light sources is adapted to emit different wavelengths than a second one of the light sources.

8. The lighting device of claim 1, wherein the user control is a single knob.

9. The lighting device of claim 1, wherein the user control is a single slider.

10. The lighting device of claim 1, wherein the lighting device is a headlamp.

11. The lighting device of claim 1, wherein the lighting device is a flashlight.

12. A method of operating a lighting device comprising a user control and a plurality of light sources, wherein each light source is adapted to exhibit an associated current brightness level within a range of brightness levels associated with each light source extending from an associated minimum brightness level to an associated maximum brightness level, the method comprising:

detecting an adjustment of the user control; and selectively adjusting the current brightness levels exhibited by the light sources in a staggered fashion in response to the detecting such that the light sources exhibit different current brightness levels from each other over at least a range of positions of the user control.

13. The method of claim 12, wherein the adjusting comprises:

adjusting a current brightness level of a first one of the light sources from a first minimum brightness level to a first maximum brightness level as the user control is adjusted over a first range of positions extending from a first position to a second position; and adjusting a current brightness level of a second one of the light sources from a second minimum brightness level to a second maximum brightness level as the user control is adjusted over a second range of positions extending from a third position to a fourth position.

14. The method of claim 13, wherein a portion of the first range overlaps with a portion of the second range.

15. The method of claim 13, wherein the first and second ranges do not overlap with each other.

16. The method of claim 12, wherein the detecting comprises detecting a user control signal received in response to the adjustment of the user control; and wherein the adjusting comprises providing a plurality of light control signals to control the light sources in the staggered fashion in response to the user control signal.

17. The method of claim 12, wherein a first one of the light sources is adapted to emit a different beam pattern than a second one of the light sources.

18. The method of claim 12, wherein a first one of the light sources is adapted to emit different wavelengths than a second one of the light sources.

19. The method of claim 12, wherein the user control is a single knob.

20. The method of claim 12, wherein the user control is a single slider.

21. The method of claim 12, wherein the lighting device is a headlamp.

22. The method of claim 12, wherein the lighting device is a flashlight.

* * * * *